US007942118B2

(12) United States Patent
Baker

(10) Patent No.: US 7,942,118 B2
(45) Date of Patent: May 17, 2011

(54) OIL SYSTEM FOR ACTIVE FUEL MANAGEMENT ON FOUR VALVE ENGINES

(75) Inventor: Rodney E. Baker, Fenton, MI (US)

(73) Assignee: GM Global Technology Operations LLC, Detroit, MI (US)

( * ) Notice: Subject to any disclaimer, the term of this patent is extended or adjusted under 35 U.S.C. 154(b) by 547 days.

(21) Appl. No.: 12/033,071

(22) Filed: Feb. 19, 2008

(65) Prior Publication Data

US 2009/0205601 A1 Aug. 20, 2009

(51) Int. Cl.
*F01L 1/34* (2006.01)

(52) U.S. Cl. ..... 123/90.16; 123/90.52; 123/90.55

(58) Field of Classification Search ..... 123/90.16, 123/90.52, 90.55
See application file for complete search history.

(56) References Cited

U.S. PATENT DOCUMENTS 6,584,942 B1 * 7/2003 Albertson et al. ..... 123/90.16
2006/0075980 A1 * 4/2006 Kim et al. ..... 123/90.12

* cited by examiner

*Primary Examiner* — Zelalem Eshete
(74) *Attorney, Agent, or Firm* — Harness, Dickey & Pierce, P.L.C.

(57) ABSTRACT

An oil system for selectively deactivating valves for specified cylinders of an internal combustion engine includes a cylinder head having a lash adjuster oil passage and a cylinder deactivation oil passage. Plugs are coupled to the cylinder head separating the cylinder deactivation oil passage into separate portions. A clearance between a portion of each plug and the head allows a controlled flow of oil to pass from the lash adjuster oil passage to the cylinder deactivation oil passage to purge air from the cylinder deactivation oil passage. A valve is operable to selectively supply pressurized oil to the cylinder deactivation oil passage to deactivate the specified cylinders.

20 Claims, 11 Drawing Sheets

OIL SYSTEM FOR ACTIVE FUEL MANAGEMENT ON FOUR VALVE ENGINES

FIELD

The present disclosure generally relates to internal combustion engines. More particularly, an oil system for cylinder valve operation is disclosed.

BACKGROUND

Internal combustion engine heads are typically constructed using a casting process. In engines containing multiple valves per cylinder, relatively complex passageways through the head casting may be formed to provide proper component clearances, lubrication and control. As additional valves and hydraulically controlled devices are added to the head, casting cores used to create the head become more complex and may be more likely to break during the casting process. The result of core breakage may include scrapping the castings or performing substantial machining operations that are not typically part of the production process.

Furthermore, some casting designs include blind bores which may allow air pockets to be formed within hydraulic passages of the head. The bores may also house machining chips which may not be easily flushed out during cylinder head cleaning.

SUMMARY

An oil system for selectively deactivating valves for specified cylinders of an internal combustion engine includes a cylinder head having a lash adjuster oil passage and a cylinder deactivation oil passage. Plugs are coupled to the cylinder head separating the cylinder deactivation oil passage into separate portions. A clearance between a portion of each plug and the head allows a controlled flow of oil to pass from the lash adjuster oil passage to the cylinder deactivation oil passage to purge air from the cylinder deactivation oil passage. A valve is operable to selectively supply pressurized oil to the cylinder deactivation oil passage to deactivate the specified cylinders.

Additionally, an oil system for selectively deactivating valves for specified cylinders of an internal combustion engine includes a cylinder head and valve lash adjusters forming part of a valve train for actuating engine valves of the specified cylinders. A solenoid valve is operable to selectively supply pressurized oil to the valve lash adjusters associated with the specified cylinders to be deactivated. A manifold coupling the solenoid valve to the cylinder head includes a trough for supplying pressurized oil to the solenoid valve. The manifold is positioned under a valve cover coupled to the cylinder head such that oil leaking from the trough remains within the engine.

Furthermore, an oil system for selectively deactivating valves for specified cylinders of an internal combustion engine includes a cylinder head having a lash adjuster oil passage and a cylinder deactivation oil passage. Valve lash adjusters forming part of a valve train for actuating engine valves of the specified cylinders are positioned within lash adjuster bores formed in the head. An oil valve is operable to selectively supply pressurized oil to the cylinder deactivation oil passage to deactivate the specified cylinders. The cylinder deactivation oil passage intersects with and terminates within one of the lash adjuster bores.

Further areas of applicability will become apparent from the description provided herein. It should be understood that the description and specific examples are intended for purposes of illustration only and are not intended to limit the scope of the present disclosure.

DRAWINGS

The drawings described herein are for illustration purposes only and are not intended to limit the scope of the present disclosure in any way.

DETAILED DESCRIPTION

Figure 1:
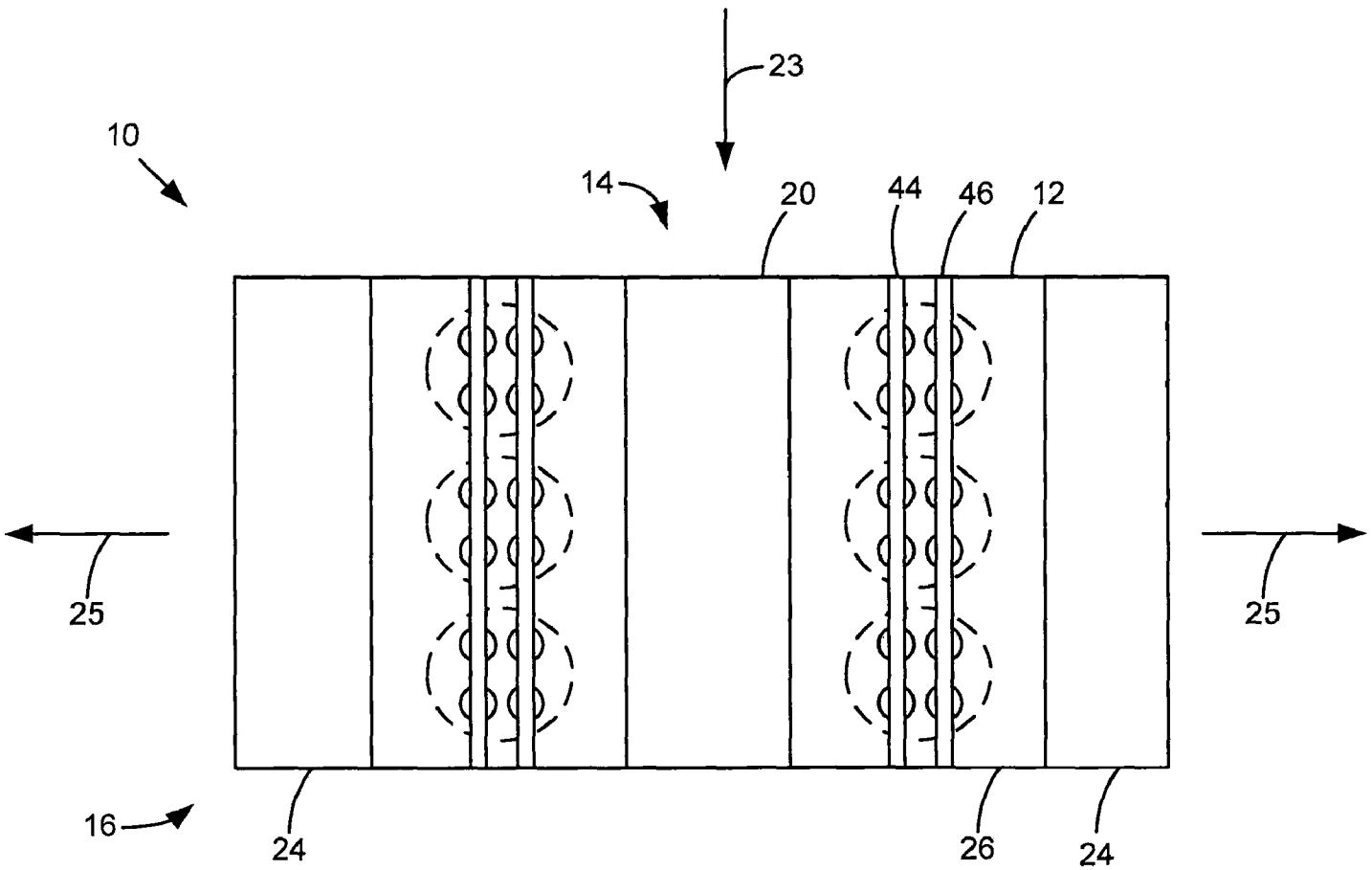
FIG. 1 is a schematic illustration of an engine assembly according to the present disclosure.
Figure 2:
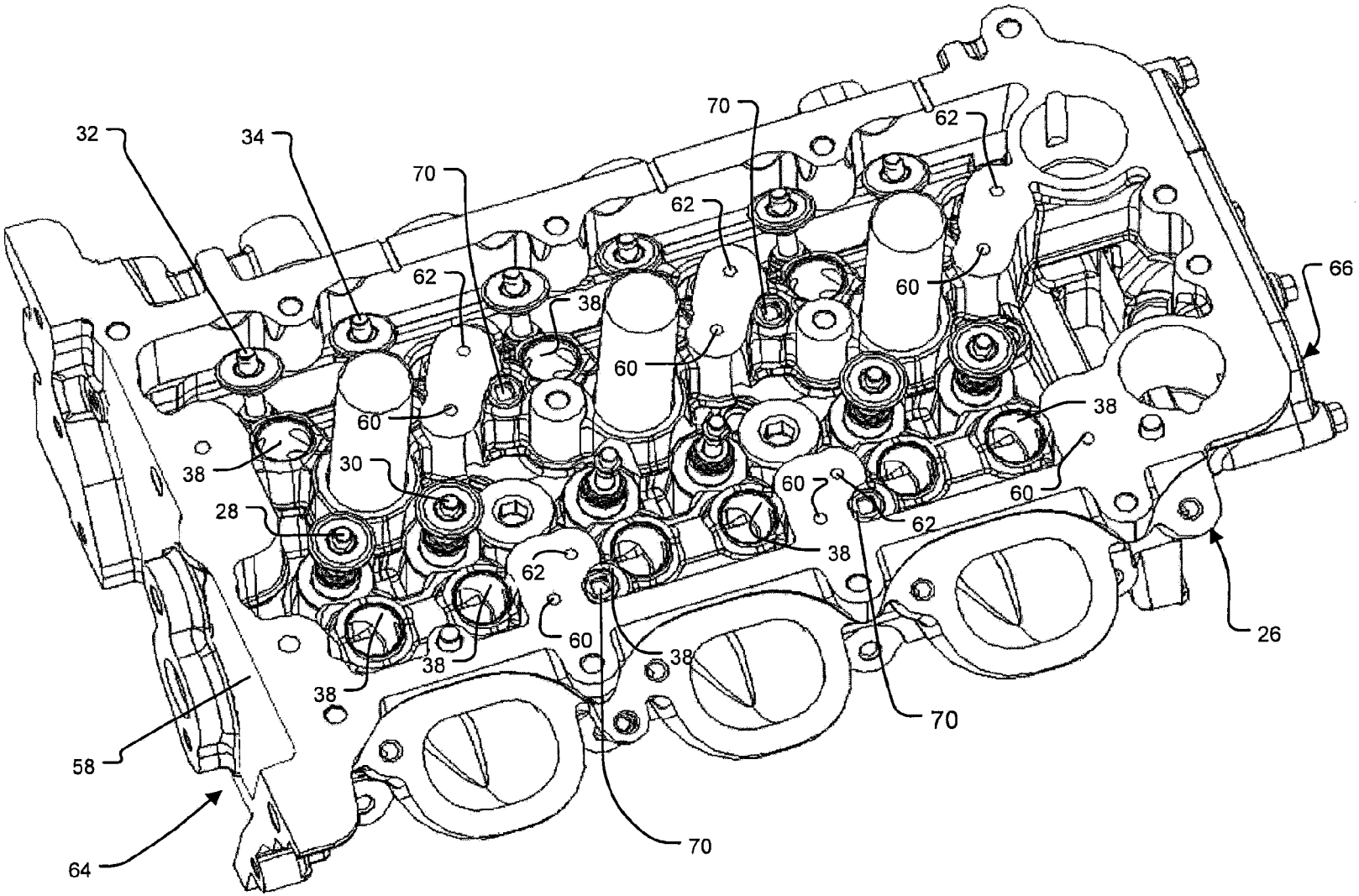
FIG. 2 is a perspective view of a partially completed cylinder head assembly.
Figure 3:
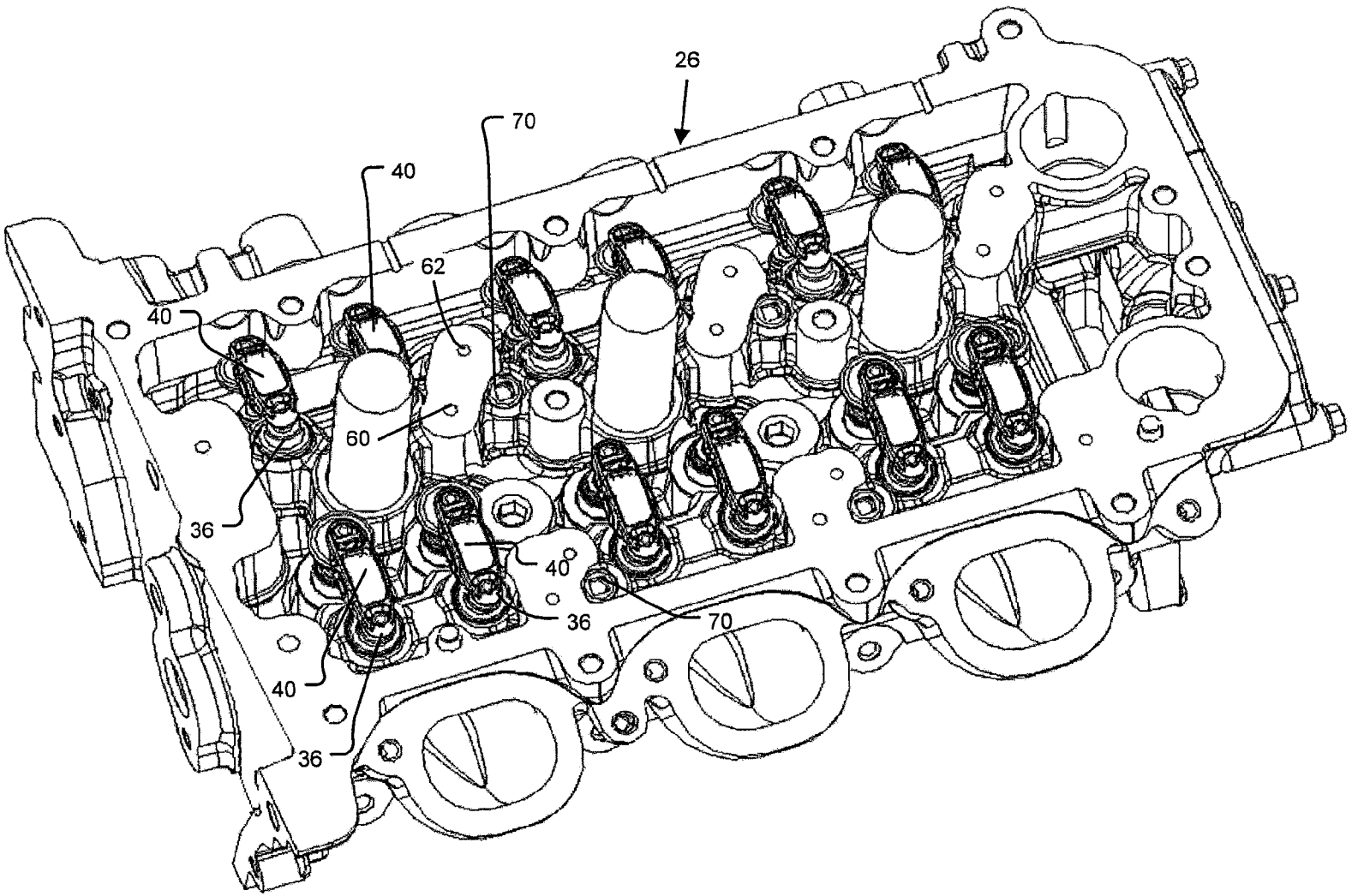
FIG. 3 is a perspective view of a partially completed cylinder head assembly including valve lash adjusters and roller rockers.
Figure 4:
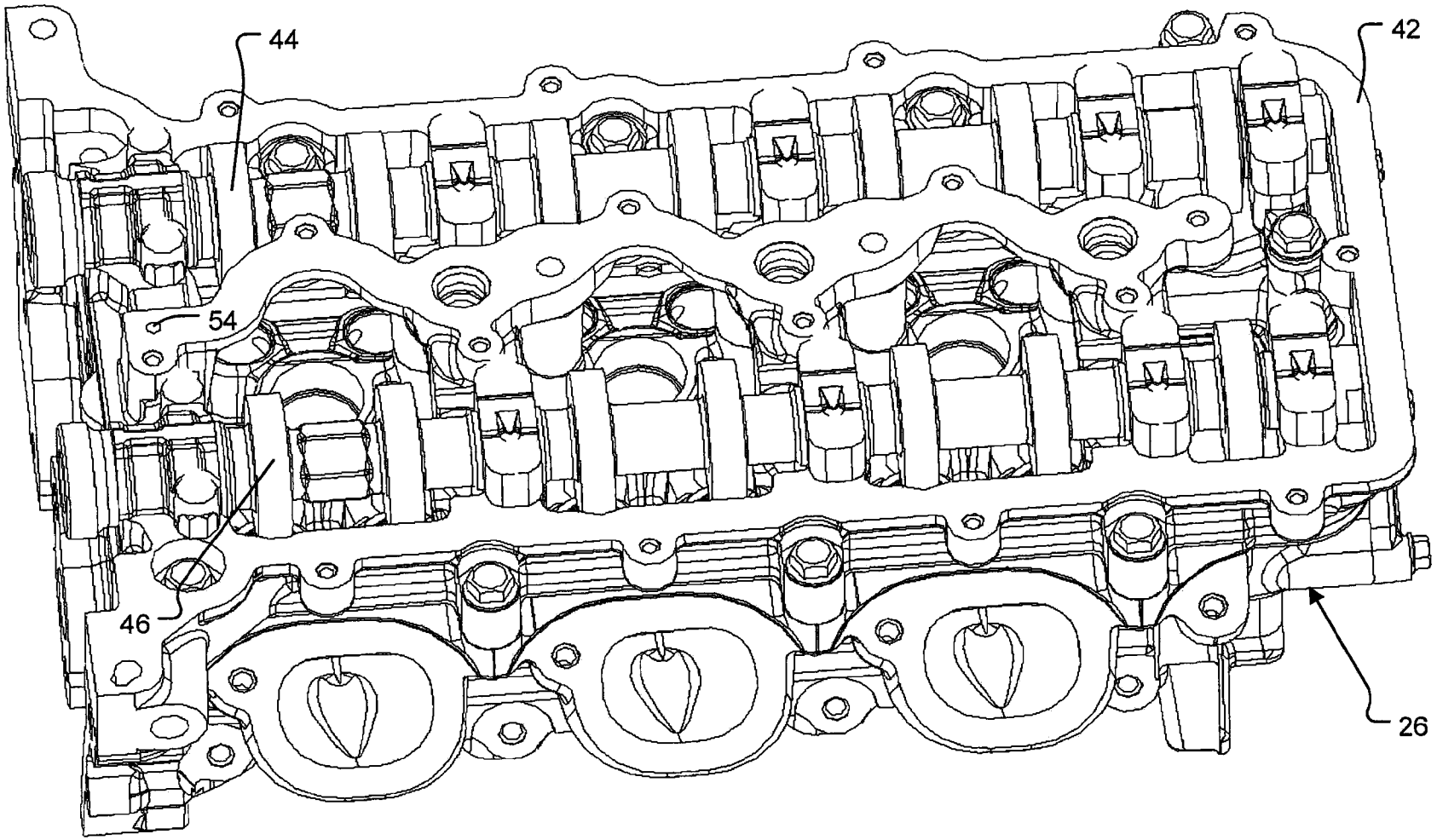
FIG. 4 is a perspective view of a partially completed cylinder head assembly including a cam cover rotatably supporting cam shafts.

The following description is merely exemplary in nature and is not intended to limit the present disclosure, application, or uses. It should be understood that throughout the drawings, corresponding reference numerals indicate like or corresponding parts and features.

Referring to FIG. 1, an exemplary engine assembly 10 is schematically illustrated. Engine assembly 10 may include an engine 12 in communication with an intake system 14, and an exhaust system 16. In the example shown, intake system 14 may include an intake manifold 20. In some applications, an intake system 14 may additionally include a throttle (not shown). Intake system 14 may supply an air flow (indicated by arrow 23) into engine 12. Exhaust system 16 may include exhaust manifolds 24 fixed to engine 12 and in communication with exhaust gas created by combustion of the air/fuel mixture. Exhaust manifold 24 may direct an exhaust gas flow (indicated by arrow 25) from engine 12.

With reference to FIGS. 2-11, engine 12 may include a cylinder head 26 associated with three cylinders formed within an engine block. Associated with each cylinder and movably mounted to head 26 are sets of first and second intake valves 28, 30 as well as first and second exhaust valves 32, 34. Hydraulic lash adjusters 36 are positioned within lash adjuster bores 38 formed in head 26. Roller rockers 40 interconnect each hydraulic lash adjuster 36 and its respective valve.

A cam carrier 42 retains an intake camshaft 44 and an exhaust camshaft 46 on head 26 such that rotation of camshafts 44, 46 cause respective motion of roller rockers 40. In turn, intake valves 28, 30 and exhaust valves 32, 34 are axially translated. As will be described in greater detail, a solenoid operated valve 48 is provided to selectively deactivate specified cylinders. One solenoid valve 48 is associated with each cylinder.

Figure 5:
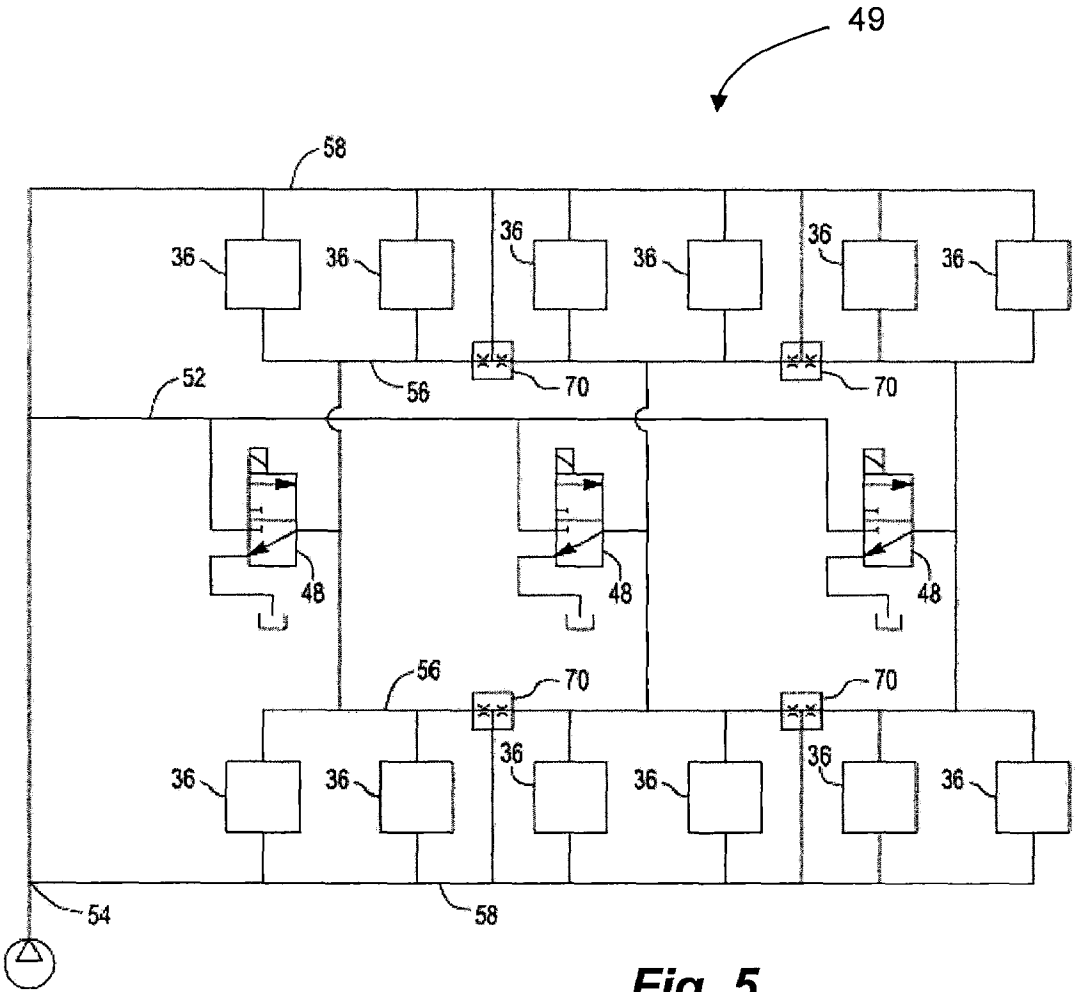
FIG. 5 is a schematic illustration of an oil system according to the present disclosure.
Figure 6:
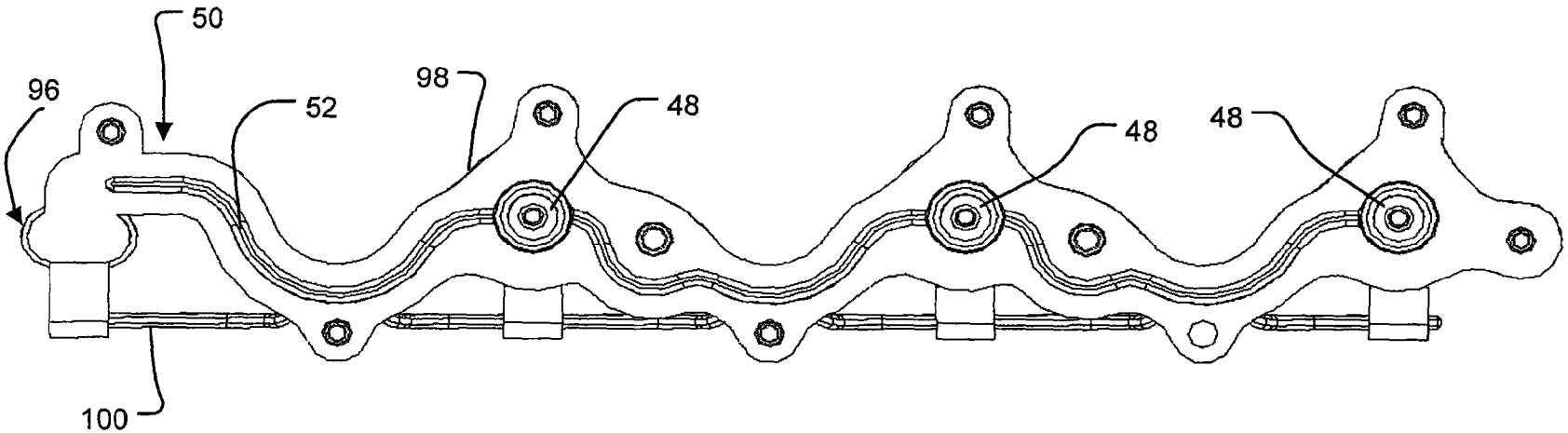
FIG. 6 is a plan view of a lifter oil manifold and solenoid valve assembly.
Figure 7:
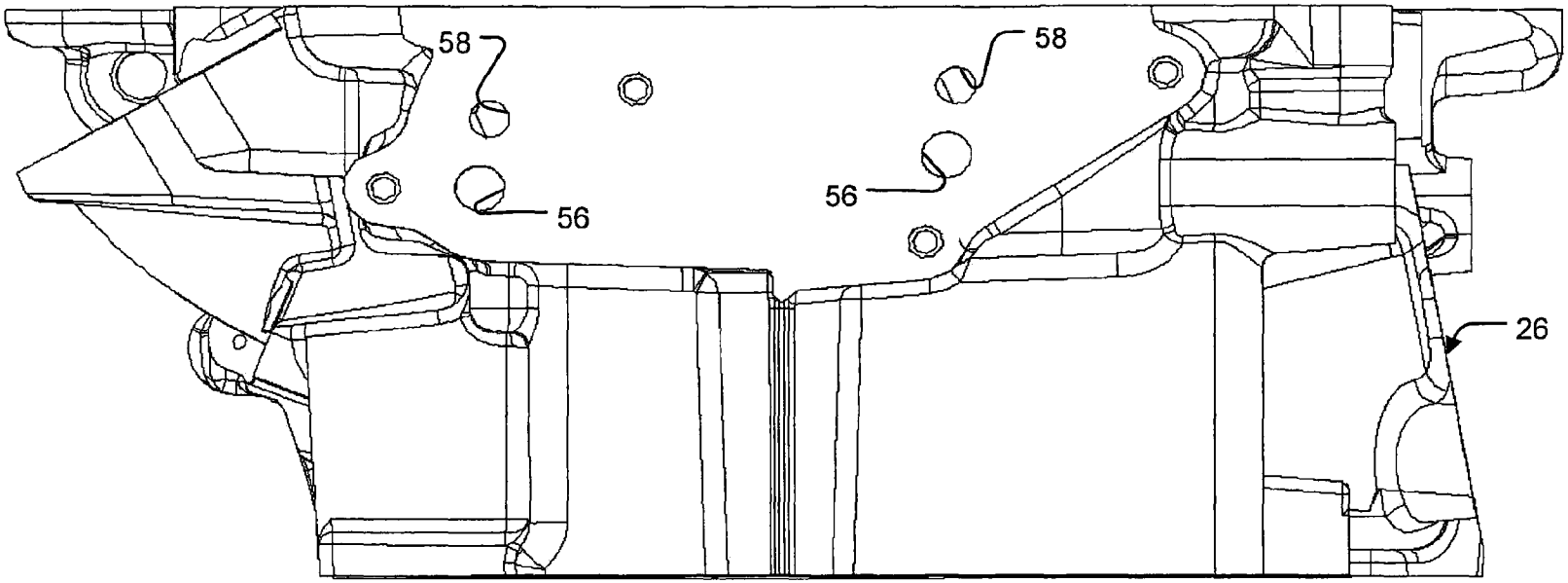
FIG. 7 is an end view of a partially completed cylinder head assembly.
Figure 8:
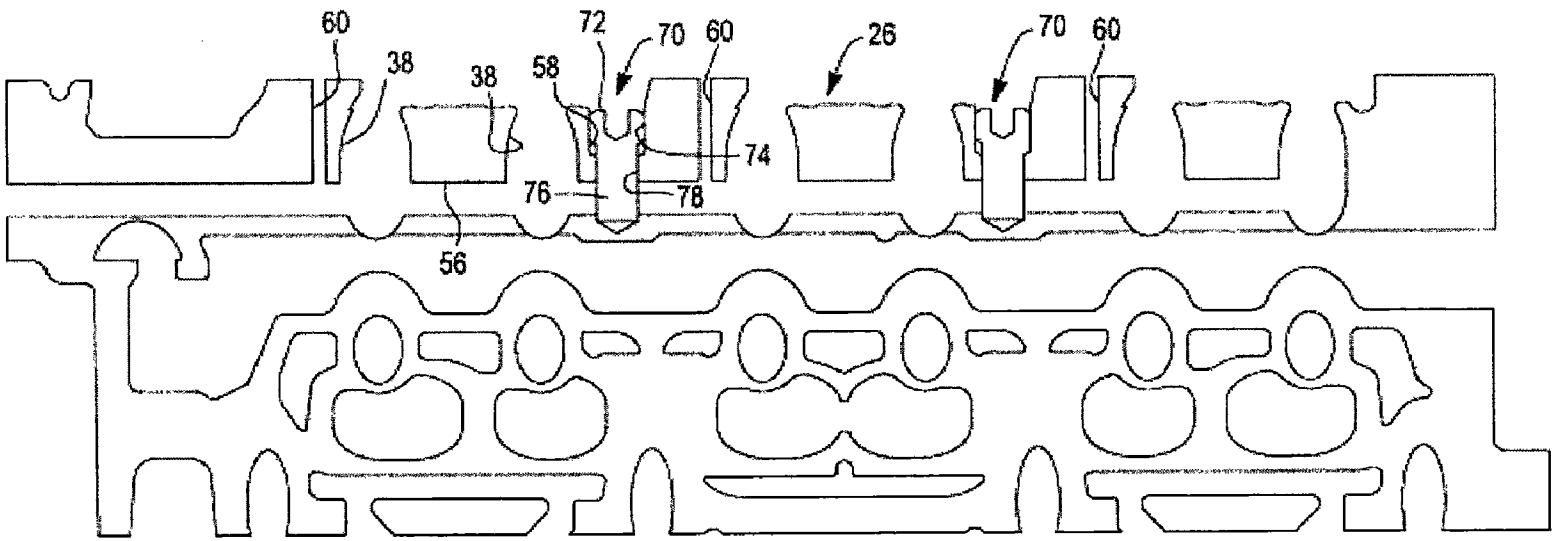
FIG. 8 is a fragmentary sectional view of the cylinder head assembly shown in FIG. 3.
Figure 9:
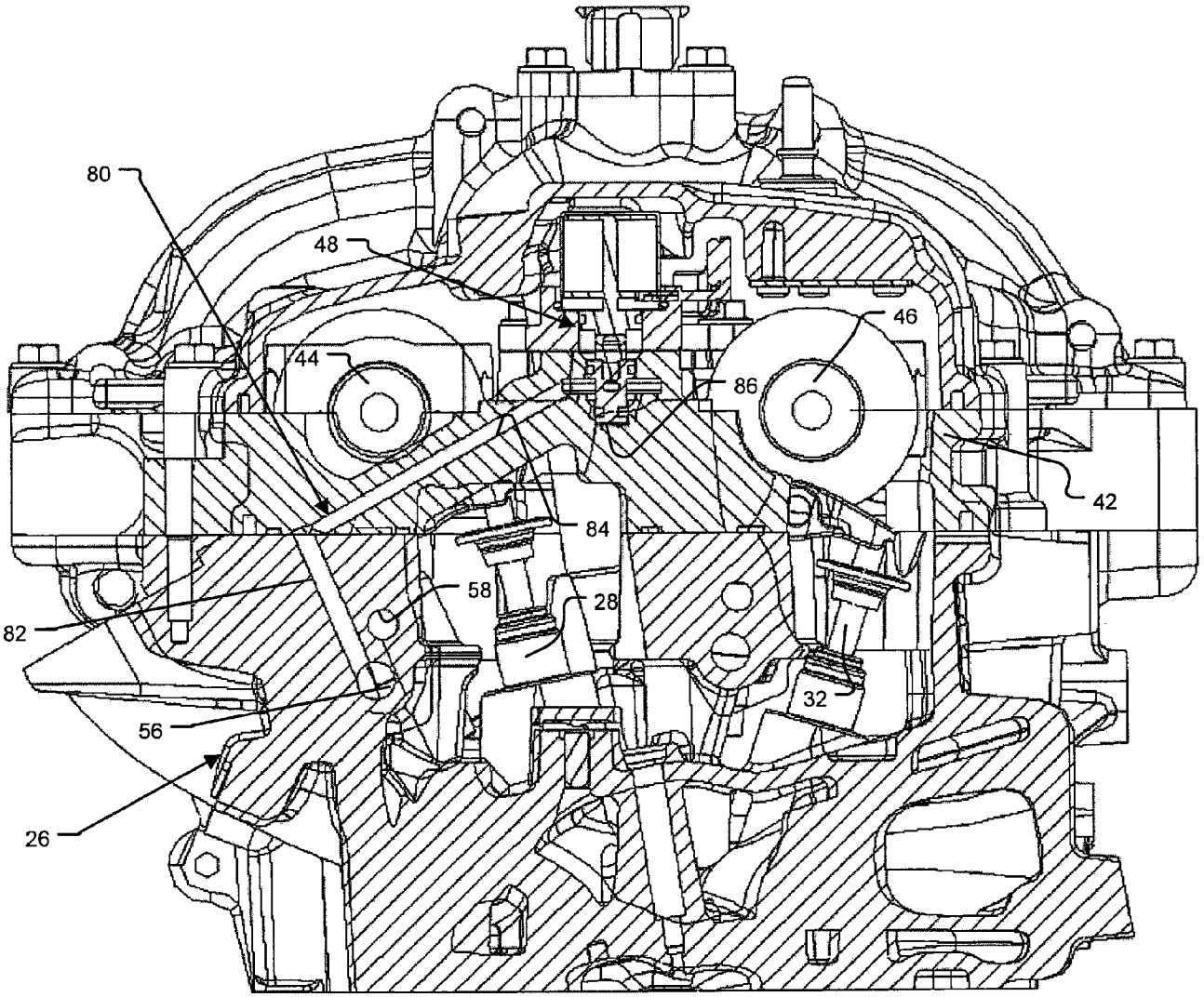
FIG. 9 is a fragmentary, partial cross-sectional view of a cylinder head assembly including a valve cover.
Figure 10:
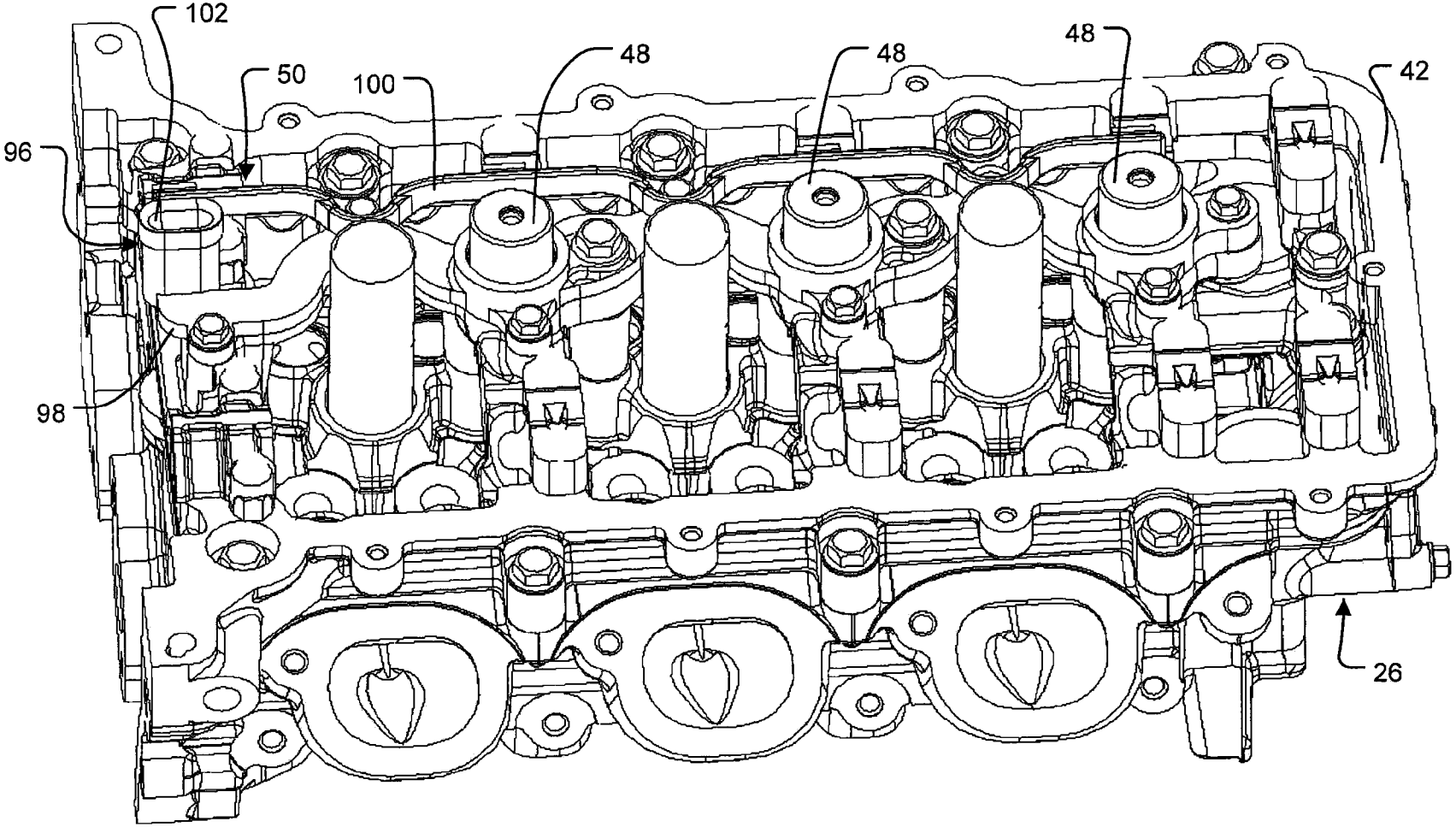
FIG. 10 is a perspective view of a partially completed cylinder head assembly including the lifter oil manifold depicted in FIG. 5.

As shown in FIG. 5, an oil system 49 is operable to provide oil to hydraulic lash adjusters 36. Oil system 49 includes a lifter oil manifold (LOM) 50 mounted to cam carrier 42. LOM 50 secures solenoid operated valves 48 to cam carrier 42 and head 26. LOM 50 includes an oil trough 52 operable to interconnect a main oil feed port 54 formed in cam carrier 42 with solenoid valves 48.

Oil system 49 further includes a pair of cylinder deactivation oil passages 56 and a pair of lash adjuster oil passages 58 formed in head 26. Lash adjuster oil passages 58 are typically provided with high pressure oil. Cylinder deactivation oil passages 56 may operate at a significantly lower pressure than lash adjuster oil passages 58. A plurality of cylinder deactivation oil transfer holes 60 are in communication with cylinder deactivation oil passages 56. Similarly, a plurality of lash adjusting transfer holes 62 are in communication with lash adjuster oil passages 58. Lash adjuster oil passages 58 are constructed to longitudinally extend all the way through head 26 exiting at a first end 64 and a second end 66 of head 26. Cylinder deactivation oil passages 56 enter from second end 66 of head 26 and terminate within the lash adjuster bore 38 closest to first end 64. Lash adjuster oil passages 58 may be constructed by machining approximately one half of the passage from first end 64 and the other half of the passage from second end 66. This method of manufacture minimizes run out of lash adjuster oil passage 58. Cylinder deactivation oil passages 56 are constructed in the manner described to reduce the tendency for air pockets to form within this passage. Furthermore, because cylinder deactivation oil passage 56 is machined to terminate within the lash adjuster bore closest to first end 64, a blind bore containing machining chips is not formed and the difficulties relating to properly cleaning such a blind bore need not be addressed.

Four cylinder plugs 70 separate cylinder deactivation oil passages 56 into six zones. Each zone corresponds to a pair of exhaust valves 32, 34 or a pair of intake valves 28, 30 associated with a given cylinder. Plugs 70 include a threaded head 72 engaged with a threaded bore 74 formed in head 26. A cylindrical body 76 having a reduced diameter is slip fit within a bore 78 formed in head 26. A predetermined clearance exists between body 76 and bore 78. Under operating conditions when all of the cylinders are active, highly pressurized oil within lash adjuster oil passages 58 may flow toward low pressure cylinder deactivation oil passages 56. Flow of oil in this direction acts to purge air out of a cylinder deactivation oil path 80 depicted in FIG. 9.

Cylinder deactivation oil path 80 includes a first portion 82 extending substantially vertically through head 26 in communication with cylinder deactivation oil passage 56. A second portion 84 of cylinder deactivation oil path 80 extends through cam carrier 42 having one end in communication with first portion 82 and another end in communication with solenoid valve 48. Solenoid valve 48 is positioned at the highest point of cylinder deactivation oil path 80 such that fluid traveling from cylinder deactivation oil passage 56 toward solenoid valve 48 will tend to purge air out of the system. As previously mentioned, the air bleeding process is accomplished by maintaining a controlled flow of oil from lash adjuster oil passages 58 past plugs 70 and into cylinder deactivation oil passage 56. Oil continues to flow through first portion 82, second portion 84 and through a dump port 86 of solenoid valve 48. It should be appreciated that this direction of oil flow occurs when all of the cylinders are active and a deactivation signal has not been sent to solenoid valves 48.

When cylinder deactivation is desired, highly pressurized oil is provided through main oil port 54 and oil trough 52 to solenoid valves 48. Solenoid valve 48 is actuated to allow the highly pressurized oil from trough 52 to pass through solenoid valve 48 and enter cylinder deactivation oil path 80. Highly pressurized oil continues to enter one or more of the six zones of cylinder deactivation oil passage 56 associated with the cylinder or cylinders desired to be deactivated. The highly pressurized oil acts on the associated lash adjusters to restrict movement of the corresponding intake valves 28, 30 or exhaust valves 32, 34.

Figure 11:
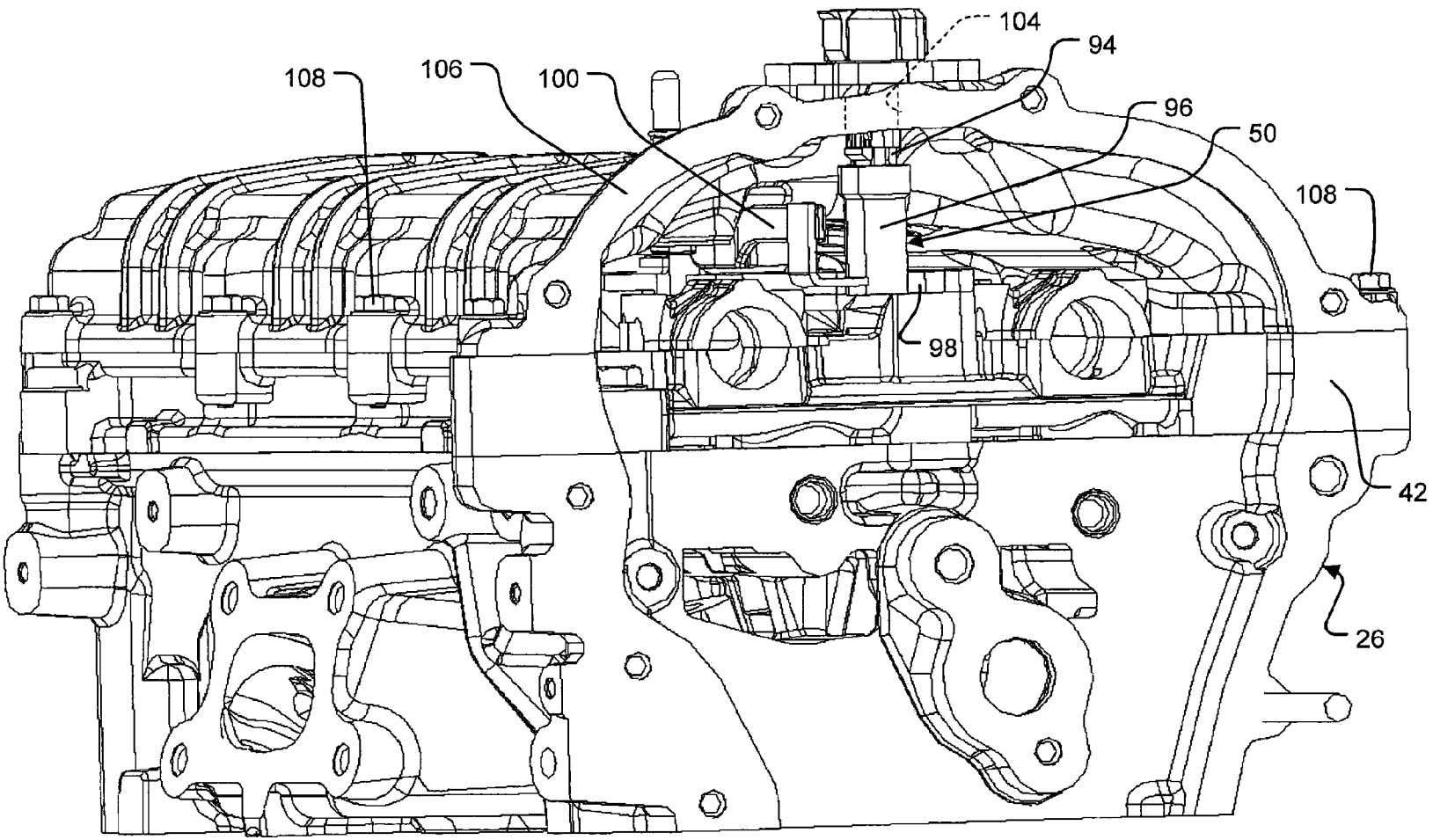
FIG. 11 is a perspective view of a partially completed cylinder head valve cover assembly.

LOM 50 also serves as an electrical conduit to protect wires 94 leading to each solenoid valve 48. LOM 50 includes a tubular portion 96 fixed to a mounting flange portion 98. Mounting flange portion 98 includes oil trough 52. A wire frame 100 is fixed to tubular portion 96 and extends substantially the entire length of head 26. Wires 94 are coupled to each solenoid valve 48 and are routed along and supported by wire frame 100. Wires 94 extend into tubular portion 96 and exit through an aperture 102 formed at the end of tubular portion 96. As shown in FIG. 11, tubular portion 96 is aligned with and extends near an aperture 104 formed in a cam cover 106. Cam cover 106 is mounted to cam carrier 42 by a plurality of fasteners 108.

Furthermore, the foregoing discussion discloses and describes merely exemplary embodiments of the present disclosure. One skilled in the art will readily recognize from such discussion, and from the accompanying drawings and claims, that various changes, modifications and variations may be made therein without departing from the spirit and scope of the disclosure as defined in the following claims.

What is claimed is:

1. An oil system for selectively deactivating valves for specified cylinders of an internal combustion engine, the oil system comprising:

a cylinder head having a first lash adjuster oil passage and a first cylinder deactivation oil passage;

plugs coupled to the cylinder head separating the first cylinder deactivation oil passage into separate portions, a clearance between a portion of each plug and the head allowing a controlled flow of oil to pass from the first lash adjuster oil passage to the first cylinder deactivation oil passage to purge air from the first cylinder deactivation oil passage; and a valve operable to selectively supply pressurized oil to the first cylinder deactivation oil passage to deactivate the specified cylinders.

2. The oil system of claim 1 wherein the first cylinder deactivation oil passage is in communication with lash adjuster bores in receipt of valve lash adjusters.

3. The oil system of claim 2 wherein the first cylinder deactivation oil passage and the first lash adjuster oil passage are associated with operation of intake valves of the engine.

4. The oil system of claim 3 further including a second cylinder deactivation oil passage and a second lash adjuster oil passage extending through the head.

5. The oil system of claim 4 wherein the second cylinder deactivation oil passage and the second lash adjuster oil passage are associated with operation of exhaust valves of the engine.

6. The oil system of claim 1 wherein the air is purged when the cylinders are activated.

7. The oil system of claim 1 wherein each separate portion of the cylinder deactivation oil passage is in communication with two lash adjuster bores.

8. An oil system for selectively deactivating valves for specified cylinders of an internal combustion engine, the oil system comprising:

a cylinder head;

valve lash adjusters forming part of a valve train for actuating engine valves of the specified cylinders;

a solenoid valve operable to selectively supply pressurized oil to the valve lash adjusters associated with the specified cylinders to be deactivated; and a manifold coupling the solenoid valve to the cylinder head and including a trough for supplying the pressurized oil to the solenoid valve, the manifold being positioned under a valve cover coupled to the cylinder head such that oil leaking from the trough remains within the engine.

9. The oil system of claim 8 wherein the manifold includes a flange portion including the trough and a tubular portion extending substantially perpendicular to the flange portion, the tubular portion being aligned with an aperture formed in the valve cover.

10. The oil system of claim 9 wherein the manifold includes a frame adapted to support a wire attached to the solenoid valve.

11. The oil system of claim 10 wherein the wire extends from the solenoid valve, through the tubular portion and through the valve cover aperture.

12. An oil system for selectively deactivating valves for specified cylinders of an internal combustion engine, the oil system comprising:

a cylinder head having a lash adjuster oil passage and a cylinder deactivation oil passage;

valve lash adjusters forming part of a valve train for actuating engine valves of the specified cylinders, the valve lash adjusters being positioned within lash adjuster bores formed in the head; and an oil valve operable to selectively supply pressurized oil to the cylinder deactivation oil passage to deactivate the specified cylinders, wherein the cylinder deactivation oil passage intersects with the lash adjuster bores and terminates within one of the lash adjuster bores.

13. The oil system of claim 12 wherein the oil valve is positioned at a top of the cylinder deactivation oil passage to allow air to be purged from the oil system.

14. The oil system of claim 13 further including a plug coupled to the head and positioned in communication with both of the cylinder deactivation oil passage and the lash adjuster oil passage.

15. The oil system of claim 14 wherein a clearance exists between a portion of the plug and the head to allow a flow of oil between the cylinder deactivation oil passage and the lash adjuster oil passage.

16. The oil system of claim 15 further including a manifold coupling the oil valve to the cylinder head and including a trough for supplying the pressurized oil to the oil valve, the manifold being positioned under a valve cover coupled to the cylinder head such that oil leaking from the trough remains within the engine.

17. The oil system of claim 16 wherein the manifold includes a flange portion including the trough and a tubular portion extending substantially perpendicular to the flange portion, the tubular portion being aligned with an aperture formed in the valve cover.

18. The oil system of claim 17 wherein the manifold includes a frame adapted to support a wire attached to the oil valve.

19. The oil system of claim 18 wherein the wire extends from the oil valve, through the tubular portion and through the valve cover aperture.

20. The oil system of claim 12 wherein the lash adjuster oil passage and the cylinder deactivation oil passage extend within the cylinder head along a longitudinal extent of the cylinder head.

* * * * *